United States Patent [19]

Dötzer et al.

[11] 3,972,784

[45] Aug. 3, 1976

[54] METHOD FOR PRETREATING SURFACES OF ELECTRICALLY CONDUCTIVE MATERIALS PRIOR TO ELECTROPLATING

[75] Inventors: Richard Dötzer, Nurnberg; Georg Iwantscheff, Nurnberg-Laufamholz, both of Germany

[73] Assignee: Siemens Aktiengesellschaft, Munich, Germany

[22] Filed: Nov. 27, 1973

[21] Appl. No.: 419,233

[30] Foreign Application Priority Data

Dec. 8, 1972 Germany ..... 2260191

[52] U.S. Cl. ..... 204/14 N; 204/29; 204/32 R

[51] Int. Cl.[2] ..... C25D 5/34; C25D 5/24

[58] Field of Search ..... 204/39, 145 F, 33, 14 N, 204/32 R, 29; 134/2, 3, 6, 7, 9; 252/194, 35, 9, 49.7, 49.5

[56] References Cited

UNITED STATES PATENTS

| | | | |
|---|---|---|---|
| 2,445,675 | 7/1948 | Lang | 204/209 |
| 2,893,931 | 7/1959 | Boyett | 204/33 |
| 2,899,367 | 8/1959 | Veeder | 204/32 |
| 3,426,378 | 2/1969 | Ashworth | 134/7 |
| 3,672,965 | 6/1972 | Harwood | 204/14 N |
| 3,691,030 | 9/1972 | Stroszynski | 204/32 R |
| 3,699,013 | 10/1972 | Miyata | 204/32 R |
| 3,778,355 | 12/1973 | Johnson et al. | 204/33 |

*Primary Examiner*—T. M. Tufariello
*Attorney, Agent, or Firm*—Kenyon & Kenyon Reilly Carr & Chapin

[57] ABSTRACT

A method for pretreating the surfaces of electroconductive materials such as metals which are to be electroplated in an aprotic oxygen- and water-free organoaluminum electrolytic media in which the last mechanical operation generating fresh and bright surfaces is performed under the exclusion of air, oxygen, and moisture using a protective gas or protective liquid and the part being treated maintained in such an environment until electroplated.

6 Claims, No Drawings

METHOD FOR PRETREATING SURFACES OF ELECTRICALLY CONDUCTIVE MATERIALS PRIOR TO ELECTROPLATING

BACKGROUND OF THE INVENTION

This invention relates to pretreating of the surfaces of electrically conductive materials in general and more particularly to a pretreatment method which can be used when preparing materials for electroplating in a aprotic, oxygen- and water-free organoaluminum electrolytic media.

Because of its ductility, freedom of pores, corrosion resistance and ability to be anodized, aluminum which is electrodeposited from an aprotic, oxygen- and water-free, organoaluminum electrolytic media has been found to be particularly well suited for many technical purposes. The metal deposited using this electrolyte is extremely pure and adheres very well to bare surfaces. However, these surfaces must be absolutely free of oxides and hydroxides. The deposition of highly adhering, homogeneous coatings which will remain free of blisters is not possible on surfaces containing oxides, hydroxides or moisture. In addition, the presence of such on the surfaces is also detrimental to the life of the electrolyte since they reduce its conductivity and its life.

It is been found that these problems can be avoided if bright work piece surfaces which are free of cover layers are used in the process. Thus, it is the object of the present invention to provide a method of pretreating materials which are to undergo this electroplating process to facilitate providing the material in a condition where its surfaces do not contain oxides, hydroxides and mositure.

SUMMARY OF THE INVENTION

The present invention achieves this end by performing the mechanical pretreatment which results in having a bright clean surface with air and moisture excluded. Thus, at least the final mechanical step which results in metal cleaning is performed in a protective environment which will comprise an aprotic oxygen- and water-free gas and/or liquid medium. In this manner, the final mechanical treatment which results in the generation of a bare surface free of any cover layer occurs in this environment and contamination of the surface is not possible. The part being treated is then maintained in an aprotic liquid environment up until the time of the electroplating process.

The method of the present invention has economic advantages in that by following this method a separate pretreatment is not necessary. In any case where part of the manufacturing process includes the formation of fresh i.e., bare surfaces, the present method may be used and the surface generated therein used as the surface for electroplating. Thus, if the part is machined such as milled, filed, sawed, drilled and so on or deformed by such as rolling, wire drawing, extruding and so on, the method of the present invention may be used to obtain material from those processes which is immediately ready for electroplating. By keeping air, oxygen and moisture away from the surfaces during this final process, the surfaces are protected against oxidation and other chemical changes and conserved in a metallically bright state. As noted above, this protection must be provided at least prior to and during the last forming and machining operation.

The bright base material surfaces which are free from cover layers remain free of oxides and hydroxides and have no skin of water. In accordance with the present invention these parts can be taken immediately after their generation, and any washing, rinsing and/or degreasing operations which may be necessary, to the aluminum electroplating operation still in an aprotic, oxygen-and water-free media. The protective gas and liquid media used in the present invention are inert with respect to the aprotic oxygen- and water-free organometallic electrolyte media and if necessary, they can be removed by an aprotic, oxygen- and water-free washing, rinsing and/or degreasing media without any effect on the bright surface of the work piece. It should be noted that the soluble cutting oils and emulsions which are normally used in the machining of metals and contain water, are not suited for the present invention.

Suitable protective gas atmospheres for the surface pretreatment are for example, nitrogen, sulfur hexafluoride, argon and hydrocarbon vapors, hydrocarbon fluoride gases, hydrocarbon chlorides and hydrocarbon fluoride-chlorides.

Suitable liquid media are water-free inert liquids or fats such as, for example, paraffin oils, silicone oils, aliphatic, aromatic and hydroaromatic hydrocarbons along with hydrocarbon fluorides and chlorides. In case these are not completely free of water, and as further protection against the absorption of water, some aluminum alkyl or electrolyte may be added to them to free them from water and oxygen through a chemical reaction.

Suitable aprotic, oxygen-free electrolytic media for example, organoaluminum electrolytes, are well known in the art and are disclosed, for example, in U.S. Pat. No. 3,448,127.

DETAILED DESCRIPTION OF THE PREFERRED EMBODIMENT

In carrying out the method of the present invention, it is only necessary that the last operation which generates fresh and therefore, bright surfaces when manufacturing a piece or part is done with air oxygen and moisture excluded for example, by one of the above named protective gases and/or protective liquids. The bright metal surface freshly generated by the mechanical shaping is immediately wetted and covered by one of the listed protective liquids and maintained away from the presence of air, oxygen and moisture. When these steps are followed, the electrodeposited aluminum which is deposited from an aprotic, water- and oxygen-free organometallic electrolytic medium has excellent adhesion to the substrate or base, particularly for light metals such as magnesium and its alloys as well as for iron, titanium, niobium, tantalum, tungsten and other oxygen-affine metals. The electrodeposited aluminum layers are homogeneous and dense and remain free of blisters.

Using the method according to the present invention, freshly manufactured work pieces and semifinished products can be forwarded to the aluminum electroplating operation without separate pretreatment (with the possible exception of a washing and rinsing step.)

The invention will be explained in further detail by the following examples:

EXAMPLE 1

A work piece is machined by milling from bar material of a magnesium alloy, using an aprotic oil. After machining, the work piece is stored in this oil until it is electroplated.

EXAMPLE 2

In this example, disks which are to be electroplated with aluminum are made from a starting material of round steel stock. The surface of the round stock is first ground off to size using aprotic oil. The stock is subsequently sawed to obtain the disk with sawing and later the storage of the pieces taking place under the cover of the aprotic oil.

EXAMPLE 3

In manufacturing of wire, for example, wire of a ferrous material, drawing down of the wire is done with about 10% per drawing die. This drawing is done under the protection of an aprotic oil and in a protective gas atmosphere, for example, an atmosphere of argon.

Thus, an improved method for the pretreating of materials which are to be electroplated in an aprotic oxygen- and water-free organoaluminum electrolytic media has been disclosed. Although specific examples of the method have been given, it will be obvious to those skilled in the art that various modifications therefrom may be made without departing from the spirit of the invention which is intended to be limited solely by the apended claims.

What is claimed is:

1. A method comprising:

a. generating a bright metal surface on an electrically conductive material by mechanical fabrication under the protection of an aprotic, oxygen and water-free protective gas atmosphere and an aprotic, oxygen and water-free liquid medium to which aluminum alkyl or organo aluminum electrolyte has been added which prevents the formation of oxides and hydroxides by air, oxygen and moisture, and b. electroplating said surface in an aprotic oxygen-free organo-aluminum electrolyte media.

2. The method according to claim 1 wherein said electrically conductive material is metal.

3. The method according to claim 1 wherein at least the last mechanical fabrication step in which bright metal surfaces are formed is done in one of said protective gas and protective liquid medium.

4. The method according to claim 5 and further including the step of maintaining the bright base material surface obtained during machining in a state where it is free of cover layers by covering it with said aprotic protective medium until the electroplating process.

5. The method according to claim 3 wherein the liquid protective medium consists of one of an, oil or fat of an aprotic nature to which aluminum alkyl or organoaluminum electrolyte has been added.

6. The method according to claim 4 wherein the liquid protective medium consists of one of an, oil or fat of an aprotic nature to which aluminum alkyl or organoaluminum electrolyte has been added.

* * * * *